US010889931B2

(12) United States Patent
Beatty et al.

(10) Patent No.: US 10,889,931 B2
(45) Date of Patent: Jan. 12, 2021

(54) BACKING SHIFTER FOR VARIABLE OR MULTI-GAUGE TUFTING

(71) Applicants: Tuftco Corporation, Chattanooga, TN (US); Paul Beatty, Chattanooga, TN (US); Jason Detty, Chattanooga, TN (US)

(72) Inventors: Paul Beatty, Chattanooga, TN (US); Jason Detty, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 121 days.

(21) Appl. No.: 16/337,989

(22) PCT Filed: Sep. 30, 2017

(86) PCT No.: PCT/US2017/054683

§ 371 (c)(1),
(2) Date: Mar. 29, 2019

(87) PCT Pub. No.: WO2018/236411

PCT Pub. Date: Dec. 27, 2018

(65) Prior Publication Data

US 2020/0056314 A1 Feb. 20, 2020

Related U.S. Application Data

(60) Provisional application No. 62/402,714, filed on Sep. 30, 2016.

(51) Int. Cl.
*D05C 15/28* (2006.01)
*D05C 15/14* (2006.01)

(52) U.S. Cl.
CPC ..... *D05C 15/14* (2013.01); *D05C 15/28* (2013.01)

(58) Field of Classification Search
CPC ..... D05C 15/28; D05C 15/145; D05C 15/12; D05C 15/14
See application file for complete search history.

(56) References Cited

U.S. PATENT DOCUMENTS 3,492,956 A * 2/1970 Webb ..... D05C 15/145 112/80.3
4,548,140 A * 10/1985 Price ..... D05C 15/145 112/80.3
4,658,739 A * 4/1987 Watkins ..... D05C 15/145 112/80.3
5,193,472 A * 3/1993 Crossley ..... D05C 15/12 112/80.41
9,290,874 B2 * 3/2016 Mathews ..... D05C 15/14

* cited by examiner

*Primary Examiner* — Tajash D Patel
(74) *Attorney, Agent, or Firm* — Miller & Martin PLLC

(57) ABSTRACT

A shiftable backing feed is utilized with a tufting machine having reciprocating needles and gauge parts for seizing yarns wherein needle plate fingers reciprocate in synchronization with the cycles of the needle bar to support the backing during penetration of the backing fabric yet allow backing shifts between stitches.

12 Claims, 14 Drawing Sheets

BACKING SHIFTER FOR VARIABLE OR MULTI-GAUGE TUFTING

The present invention claims priority to PCT Application PCT/US2017/054683 filed Sep. 30, 2017, which claims priority to U.S. Provisional Application Ser. No. 62/402,714 filed Sep. 30, 2016.

FIELD OF THE INVENTION

This invention relates to tufting machines and more particularly to a method and apparatus for shifting the backing fabric during tufting in a fashion that can allow for increasing (or decreasing) the density of the pile fabric produced, and further to providing patterning effects and streak break-up in the resulting tufted fabrics.

BACKGROUND OF THE INVENTION

In the production of tufted fabrics, a plurality of spaced yarn carrying needles extend transversely across the machine and are reciprocated cyclically to penetrate and insert pile into a backing material fed longitudinally beneath the needles. During each penetration of the backing material a row of pile is produced transversely across the backing. Successive penetrations result in longitudinal columns of pile tufts produced by each needle. This basic method of tufting limits the aesthetic appearance of tufted fabrics. Thus, the prior art has developed various procedures for initiating relative lateral movement between the backing material and the needles in order to laterally displace longitudinal rows of stitching and thereby create various pattern effects, to conceal and display selected yarns, to break up the unattractive alignment of the longitudinal rows of tufts, and to reduce the affects of streaking which results from variations in coloration of the yarn.

One procedure for laterally displacing rows of stitching has been to jog or shift the needle bar transversely across the tufting machine relative to the base material in a step-wise manner in accordance with a pattern. Exemplary of this prior art are reflected in U.S. Pat. Nos. 3,026,830; 3,964,408; 3,972,295; 4,010,700; 4,173,192; 4,392,440; 4,841,886; and 5,224,434.

It is also known to initiate relative movement between the backing material and the needles by jogging or shifting the needle plate, i.e., the plate over which the backing material is fed and which carries a plurality of fingers between which the needles extend during penetration of the backing. Exemplary of this prior art are U.S. Pat. Nos. 3,301,205; 3,577,943; 3,934,524 and 3,964,407. U.S. Pat. No. 4,224,834 operates similarly by shifting a pin roll that is slideably mounted in the needle plate.

Another procedure for initiating relative lateral shifting between the needle and the backing material is by the use of what is known as a "jute shifter" wherein the gauge parts, i.e., needles and loopers, or hooks, etc., remain laterally stationary while the backing material alone is shifted usually by spike rollers upstream and/or downstream of the feed direction. However, when synthetic, as opposed to jute backing, was introduced, difficulties resulted since the synthetic backings are more difficult to shift than jute backings. The synthetic backings do not respond positively in every instance or uniformly to the movement of the rollers. Consequently, use of such "jute shifters" have not been in favor in broadloom tufting, although exemplary of this technique in the prior art are U.S. Pat. Nos. 3,100,466; 3,393,654; and 9,290,874.

Another reason for initiating relative lateral movement between the needles and the backing material is to increase the density of the fabric by placing the stitches closer together laterally than the gauge of the machine, and in fact this was the main objective in a number of the referenced patents including U.S. Pat. Nos. 3,577,943 and 3,934,524. Another proposal for increasing the density of the pile fabrics produced by tufting was illustrated in U.S. Pat. No. 3,596,617 in which the loopers and cutting knives were to be simultaneously shifted together with the needles and this was proposed at a time when relatively fine gauge tufting machines were not developed to a practical extent. However, this mechanism itself was found to be exceptionally complex and too impractical, and thus was never used in production. It has been more common in broadloom tufting to achieve these slight shifts of the backing relative to stitch location by shifting the needle bar while the needles are within the fabric to move the fabric slightly and thereby increase the density. These needle offset techniques have been known as "positive stitch placement" and "dual stitch placement", generally described in U.S. Pat. No. 4,630,558.

In current tufting, most backing shifting has been directed to tufting machines that have needles capable of supplying one of several yarns with such needles spaced apart from one another by a half-inch or more. Typical of such machines are those described in U.S. Pat. Nos. 4,254,718; 5,165,352; 5,588,383; and 6,273,011, and embodied in commercial tufting machines sold by Tapistron, or in the later iTron tufting machines from Tuftco.

The backing shifter in these tufting machines of the type that select from one of several yarns to tuft are different from conventional broadloom tufting machines. Conventional broadloom tufting machines usually have needle plates placed below the needles with yarn being fed downward through openings in the eyes of the needles and then reciprocated between fingers or openings in the needle plates. In a broadloom loop pile machine, the loopers are positioned below the needle plate. The backing goes over the top of the needle plates with needle plate fingers being used to support the backing when it is pushed downward by the penetration load of the yarn carrying needles. The penetration load is substantial because the needles are usually spaced between ¼ and 1/12 inch apart, and because yarns carried by the needles may drag on the backing as the yarns are carried through the backing to be seized by the loopers or other gauge parts.

Since the loops on conventional broadloom tufting machines are continuous as they are formed on the base below the backing, it is not possible to effectuate an efficient backing shift in the needle area because of the needle plate location with needle plate fingers between columns of pile tufts. Attempting to shift the backing to any substantial degree, even a single gauge unit of the needle bar, causes the tufted face yarns to interfere with the needle plate fingers. Accordingly, in such a tufting machine, there have been attempts to use a pin roll positioned at a distance permitting tangential engagement of the backing layer, approximately two or three inches from the needle location, to move the backing a considerable distance to achieve a smaller movement of the fabric at the needle. Due to both the location of the pin rolls and the natural drag which is encountered because loops are positioned between needle plate fingers in proximity of the tufting zone it has not been possible to efficiently and precisely shift backing.

The backing shifter on iTron multi-color tufting machines has evolved to shift an entire assembly with forward and rear pin rolls being dispersed on each side of the tufting zone.

This general structure was imitated in U.S. Pat. No. 9,290,870 for use in broadloom tufting machines but no explanation provided as to how the backing shifter interfaces with the needle plate in shifting operation.

Tufting machines used in the manufacture of artificial turf have also employed backing shifters, and these machines are notable not only for typically using a long stroke, but also for using very large yarns and needles. Needle spacing on a tufting machine for artificial turf may be on the order of ½ inch or ⅝ths of an inch. Yarns are usually fed with a roll attachment and often a tall principal yarn is fed from one side of the machine and a lower height "thatch" yarn is fed from the other side. Often multiple filaments are threaded in a single needle to provide a bloom-like effect. Even with artificial turf, it is often desired to obtain a denser placement of tufts than the four tufts per square inch that would be provided with uniform spacing of stitches from a half inch gauge needle bar. A backing shifter or other technique to introduce lateral movement between the needles and the backing is often employed to achieve an affect approaching that of a $\frac{1}{4}^{th}$ gauge needle bar, although the stitches are generally not strictly on gauge lines. The imperfect placement of stitches in the artificial turf setting is not of particular consequence because the blooming effect of multiple filaments and the addition of infill material at installation tends to conceal minor irregulates. Backing shifting for this purpose is not impeded by needle plate fingers because the typical amount of the backing shift is only about $\frac{1}{4}^{th}$ inch in either direction, which is only half of the gauge spacing of the needle bar.

It would be desirable to have a tufting machine that could utilize backing shifting in a fashion that was not constrained by the gauge of the needle bar.

SUMMARY OF THE INVENTION

Accordingly, the present invention is directed to a backing shifter for use on broadloom tufting machine that is able to operate in a fashion that permits the shifting of the backing fabric relative to the needles and gauge parts without undo interference and thereby permits shifting not simply in gauge increments, but in a fashion that allows the creation of variable gauge and novel fabrics. This allows the tufting machine to create patterns similar to those created on a number of different tufting machines and it can be utilized to provide additional capacity for many desired product lines in the event of the need for extra capacity.

BRIEF DESCRIPTION OF THE DRAWINGS

Particular features and advantages of the present invention will become apparent from the following description when considered in conjunction with the accompanying drawings in which.

DETAILED DESCRIPTION OF THE ILLUSTRATED EMBODIMENTS

Figure 1:
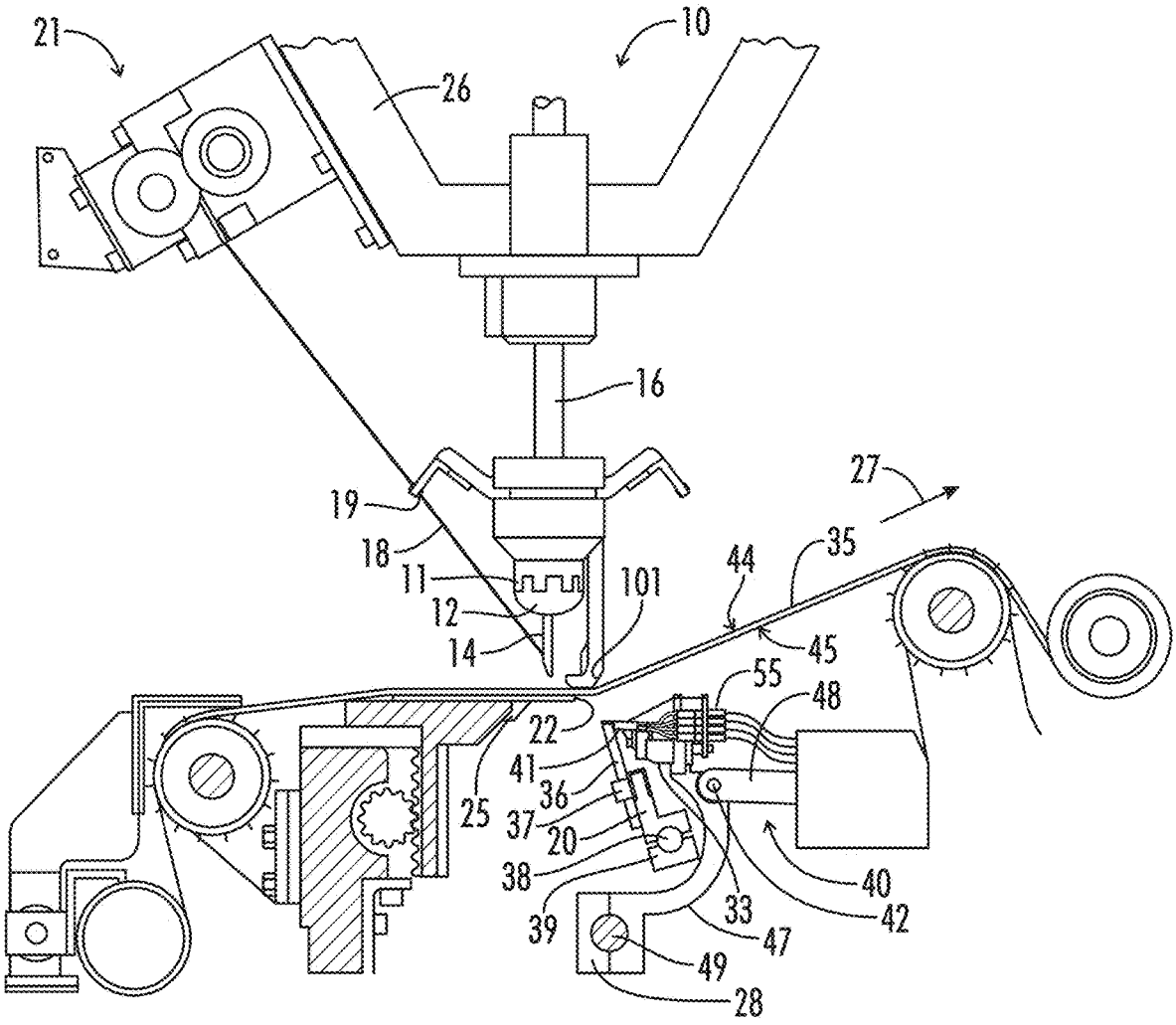
FIG. 1 (PRIOR ART)
FIG. 1 is a partial sectional end view of a prior art tufting machine with a single row of needles that can be operated to place yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21 though simpler yarn feed arrangements such a roll feeds may be employed. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well-known manners. The backing fabric 35 is supported upon the needle plate 25 having rearward projecting transversely spaced front needle plate fingers 22, the fabric 35 being adopted for longitudinal movement from front-to-rear in a feeding direction, indicated by the arrow 27, through the tufting machine 10. The needle bar may have a single row of gauge spaced needles as shown, or may be a staggered needle bar with front and rear rows of needles, or may even be two separate needle bars, each with a row of needles.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the back-stitch side 44 of backing fabric 35 to form loops on the face 45 thereof. After the loops are formed in this tufting zone, the needles 14 are vertically withdrawn to their elevated, retracted positions. A yarn seizing apparatus 40 in accordance with this illustration includes a plurality of gated hooks 41, there preferably being at least one gated hook 41 for each needle 14.

Each gated hook 41 is provided with a shank received in a corresponding slot in a hook bar 33 in a conventional manner. The gated hooks 41 may have the same transverse spacing or gauge as the needles 14 and are arranged so that the bill of a hook 41 is adapted to cross and engage with each corresponding needle 14 when the needle 14 is in its lower most position. Gated hooks 41 operate to seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference.

It can be seen in FIG. 1 that the tufted greige 35 with backstitch side 44 and face side 45 is lifted away from the tufting zone after passing presser foot 101. When employing a backing shifter, it is necessary to move the face side 45 away from the hook apparatus of a cut pile or cut loop configuration as the lateral shifting of the backing could cause interference between the tufted yarns on the face 45 and the hooks 41. For the purposes of using the backing shifting apparatus of the present invention, it is preferable that the yarn seizing gauge parts be loopers that are disengaged from the loops of yarn after each stitch rather than hooks that often need to carry a yarn for one or more additional stitches to effect a cut pile.

Figure 2:
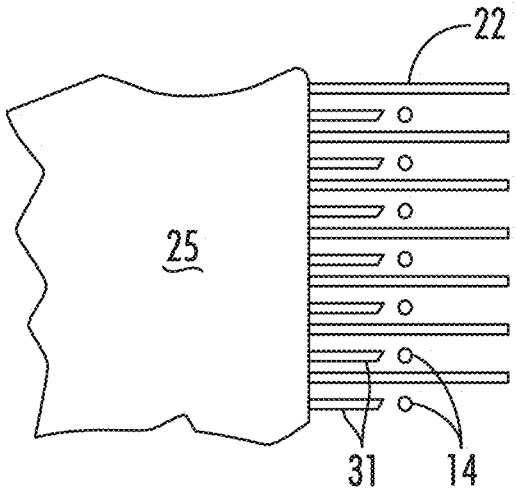
FIG. 2 is a top sectional view of a single row of needles and loopers that can be used in the manufacture of loop pile tufted fabrics.
Figure 4A:
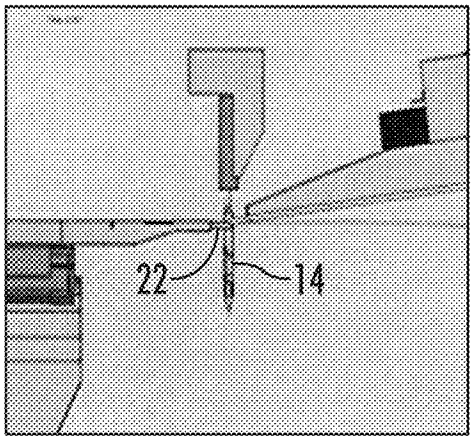
FIGS. 4A-4F are sequential side plan views of a tufting cycle corresponding to FIGS. 3A-3F.
Figure 3A:
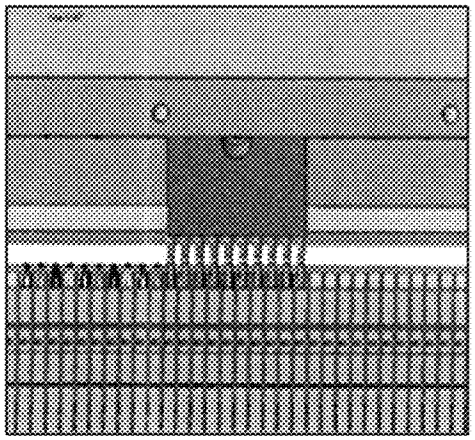
FIGS. 3A-3F are sequential front plan view of a tufting cycle of shifting backing feed and reciprocating needle plate through a tufting cycle.

FIG. 2 is a top view of a needle bar with a single row of needles 14 associated with loopers 31 and where a backing fabric, not shown, would pass over needle plate 25 and needle plate fingers 22 for tufting. The loopers 31 reciprocate in the forward direction when not seizing loops of yarn, in a fashion opposite to the movement of gated hooks 41 or cut pile hooks, and as a result tend to be away from the face side 45 of the tufted greige 35. This makes loopers 31 less likely to interfere with yarns tufted on the face of the greige when the backing is laterally shifted. Therefore most implementations of the present invention more useful with loop pile configurations.

Figure 5A:
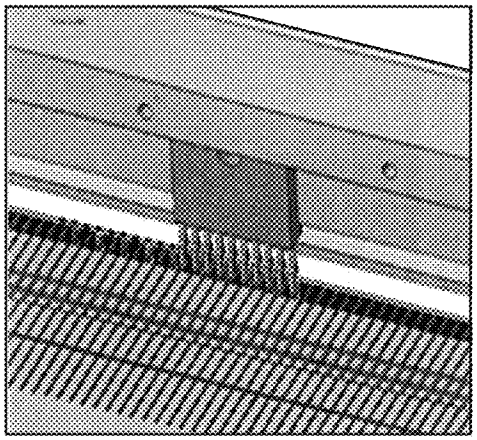
FIGS. 5A-5F are sequential front perspective views of a tufting cycle corresponding to FIGS. 3A-3F.
Figure 5B:
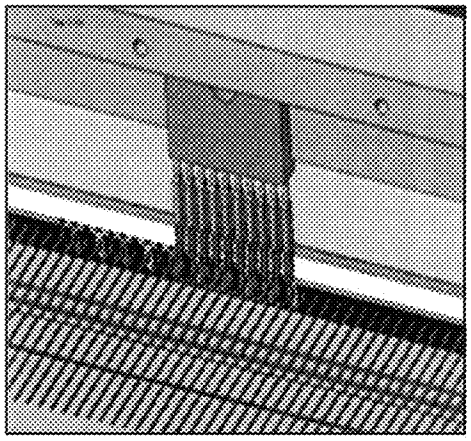
Figure 4B:
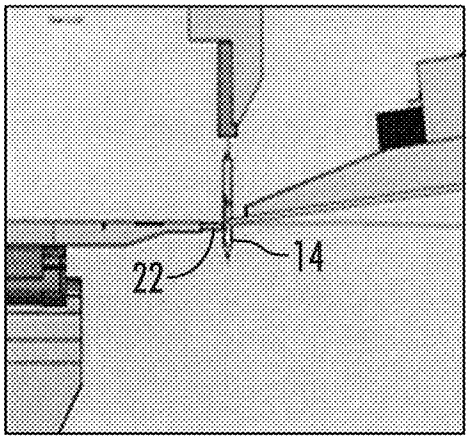
Figure 3B:
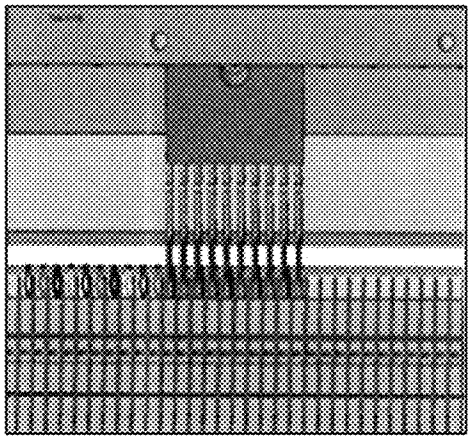
Figure 5C:
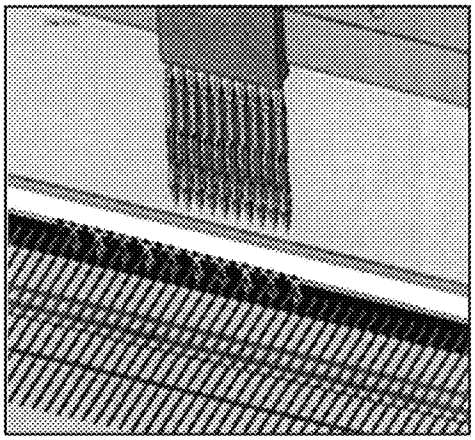
Figure 4C:
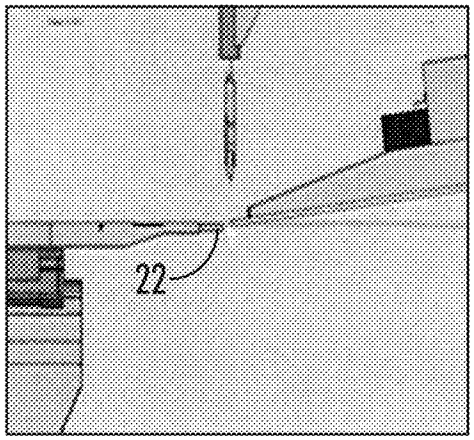
Figure 3C:
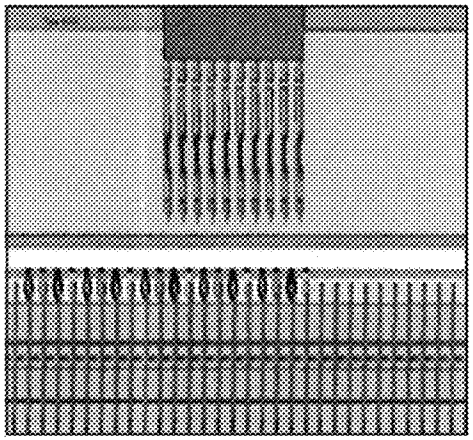
Figure 5D:
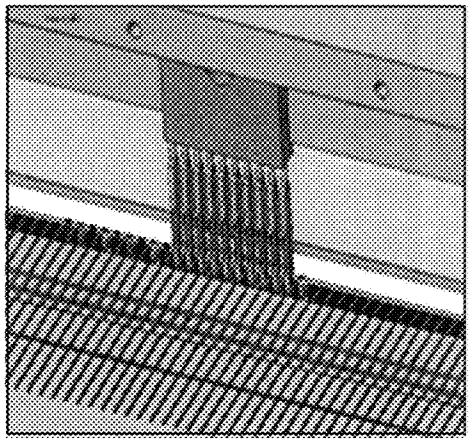
Figure 4D:
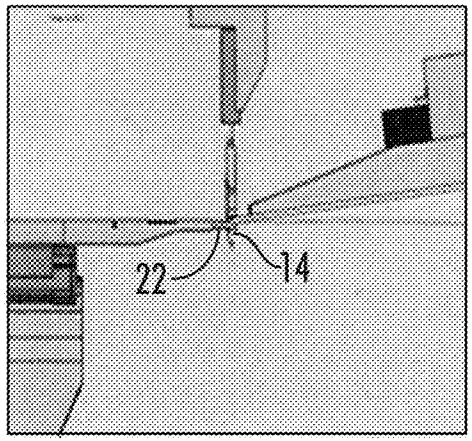
Figure 3D:
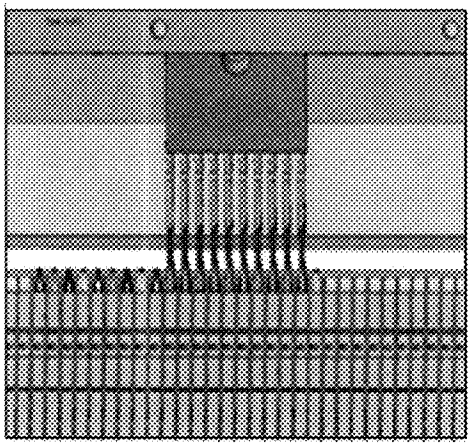
Figure 3E:
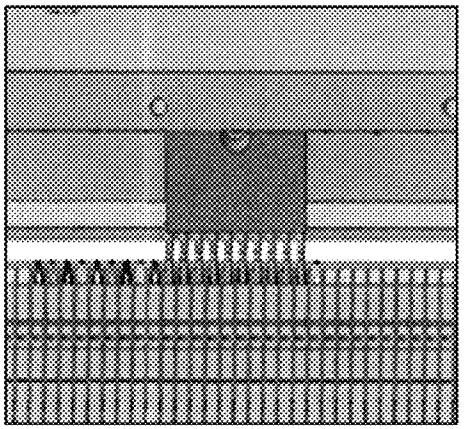
Figure 4E:
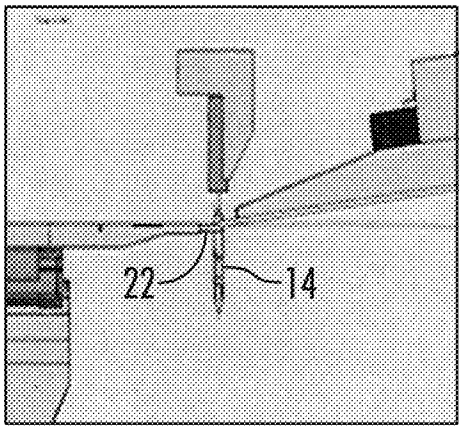
Figure 5E:
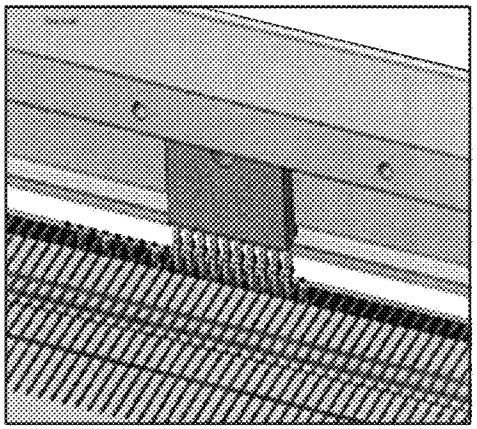
Figure 3F:
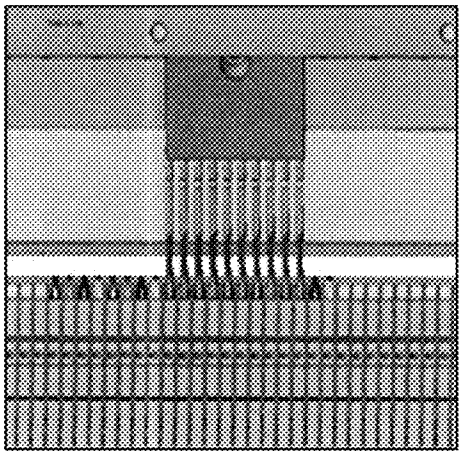
Figure 4F:
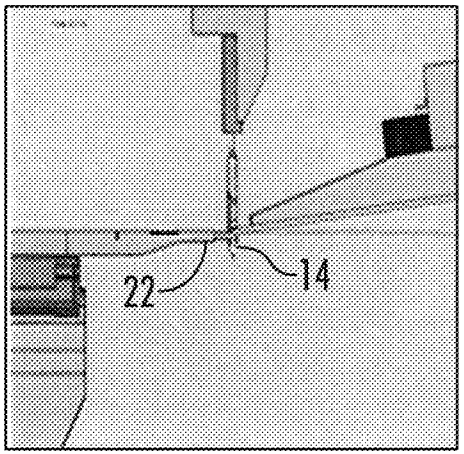
Figure 5F:
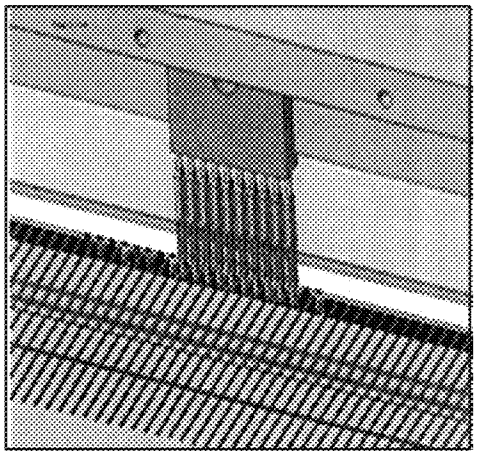

FIGS. 3A-F and corresponding views in FIGS. 4A-F and 5A-F illustrate the tufting zone movement of the needle plate fingers 22 in the new shiftable backing fabric design. It can be observed in FIGS. 3A, 4A, 5A that the needle plate finger 22 extends essentially to the presser foot and through much of the diameter of the needle 14 passing behind the needle plate finger. As the needle 14 moves upward retracting from the backing fabric, the needle plate finger is similarly retracted toward the front of the tufting machine as shown in FIGS. 3B, 4B, 5B. In FIGS. 3C, 4C, 5C, the needle is free of the backing fabric and space exists between the needle plate fingers 22 and presser foot. As the needles 14 again move downward in FIGS. 3D, 4D, 5D, the needle plate fingers 22 move forward to support the backing fabric and remain in that position through the downward stroke as shown in FIGS. 3E, 4E, 5E but again begin to retract as needles 14 are removed from the backing fabric in FIGS. 3F, 4F, 5F.

Figure 6A:
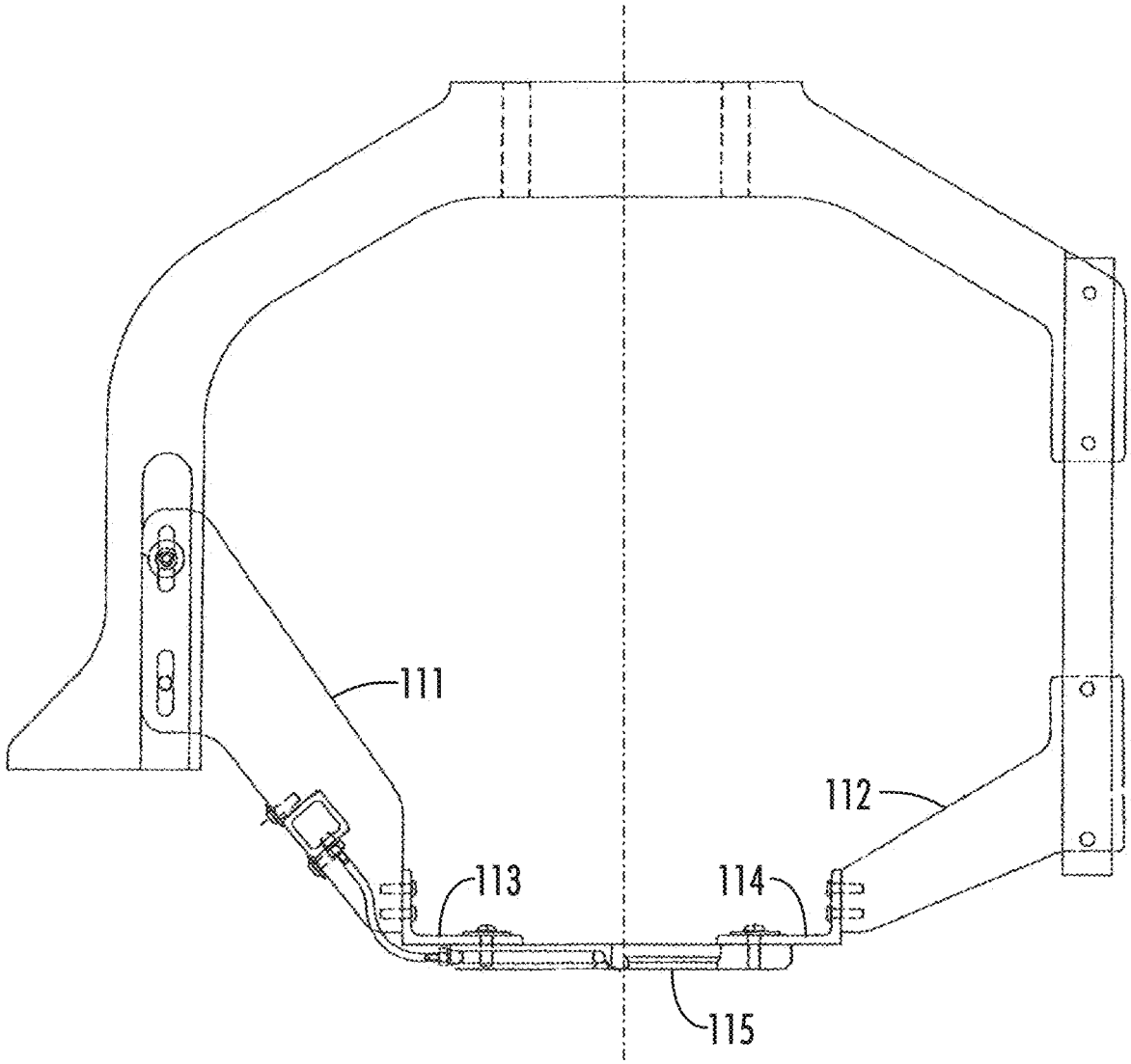
FIG. 6A (PRIOR ART)
FIG. 6A is a side plan view of a prior art presser foot assembly for backing shifter used on a hollow needle type tufting machine.
Figure 6B:
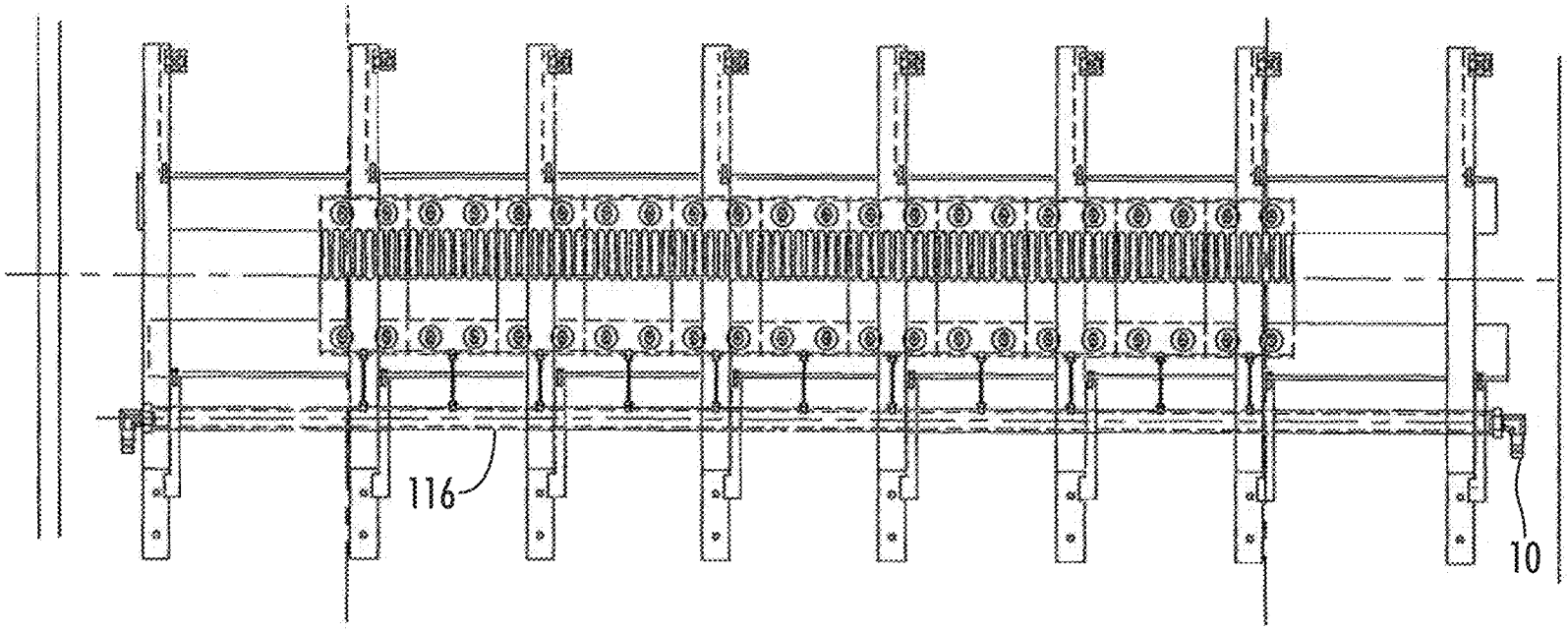
FIG. 6B (PRIOR ART)
FIG. 6B is a top plan view of the presser foot assembly illustrated in FIG. 6A.
Figure 7:
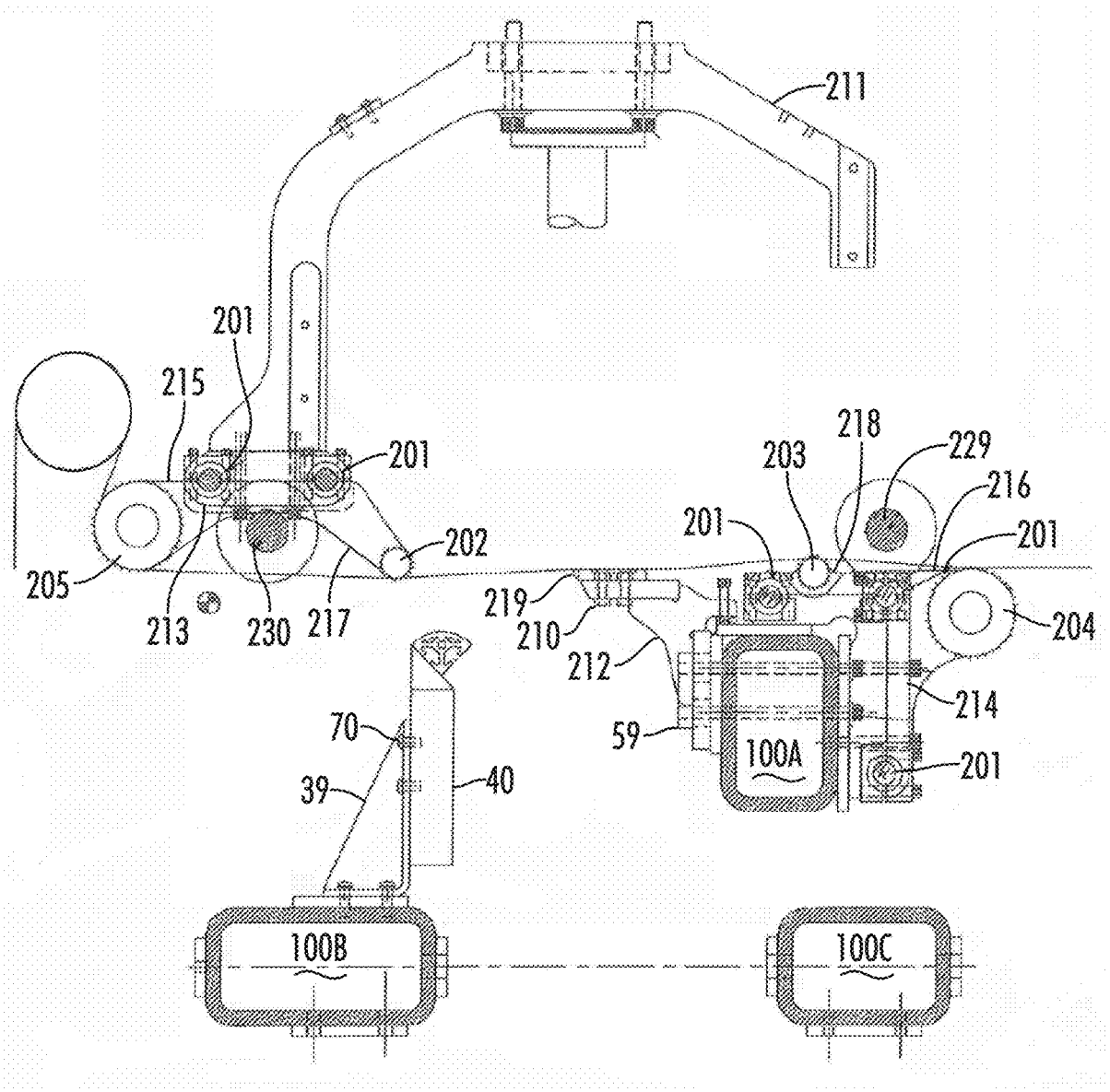
FIG. 7 (PRIOR ART)
FIG. 7 is a side sectional view of a prior art shiftable cloth feed assembly used on a hollow needle type tufting machine.

The reciprocating needle plate fingers of FIGS. 3-5 are suitable to be mounted in a slightly modified prior art backing shifting assembly such as that shown in FIGS. 6-9, with presser foot supports 111, 112 presser foot support angles 113, 114, presser foot plate 115, presser manifold 116. as shown in FIGS. 6A and B. FIG. 7 shows the prior art cloth feed assembly with bearing support bracket 211, bedplate rail 212, bearing housings 213, 214, three inch roll supports 215, 216, one inch roll supports 217, 218, support plate 219, nut bar 210, three inch tension rolls 204, 205, one inch pin rolls 202, 203, drive rods 229, 230, drive blocks 231, 232, and corner angle 39. Bearings 201 allow the roll supports 215-218 to move laterally with respect to the bearing support brackets 211 that are secured to the tufting machine. The needle plate 219 is replaced by a reciprocating needle plate as shown in FIGS. 10 and 11.

Figure 8B:
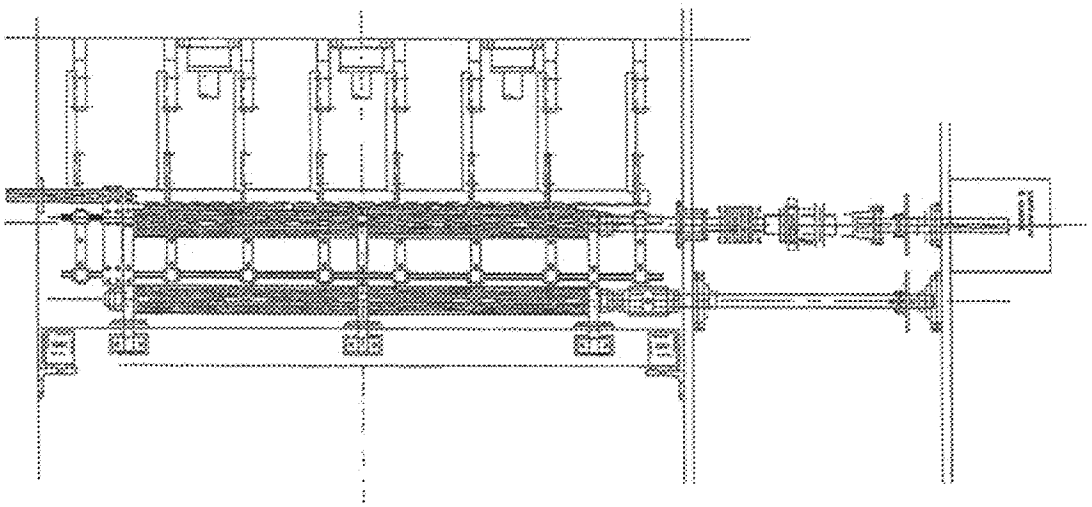
FIG. 8B is a front plan view of the tension roll assembly of FIG. 8A.
Figure 8A:
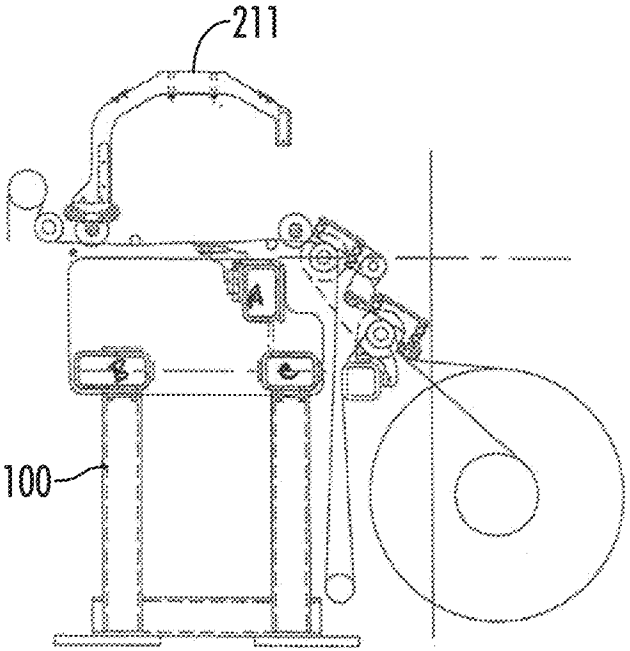
FIG. 8A is a side plan view of a prior art tension roll assembly used on a hollow needle type tufting machine.
Figure 9:
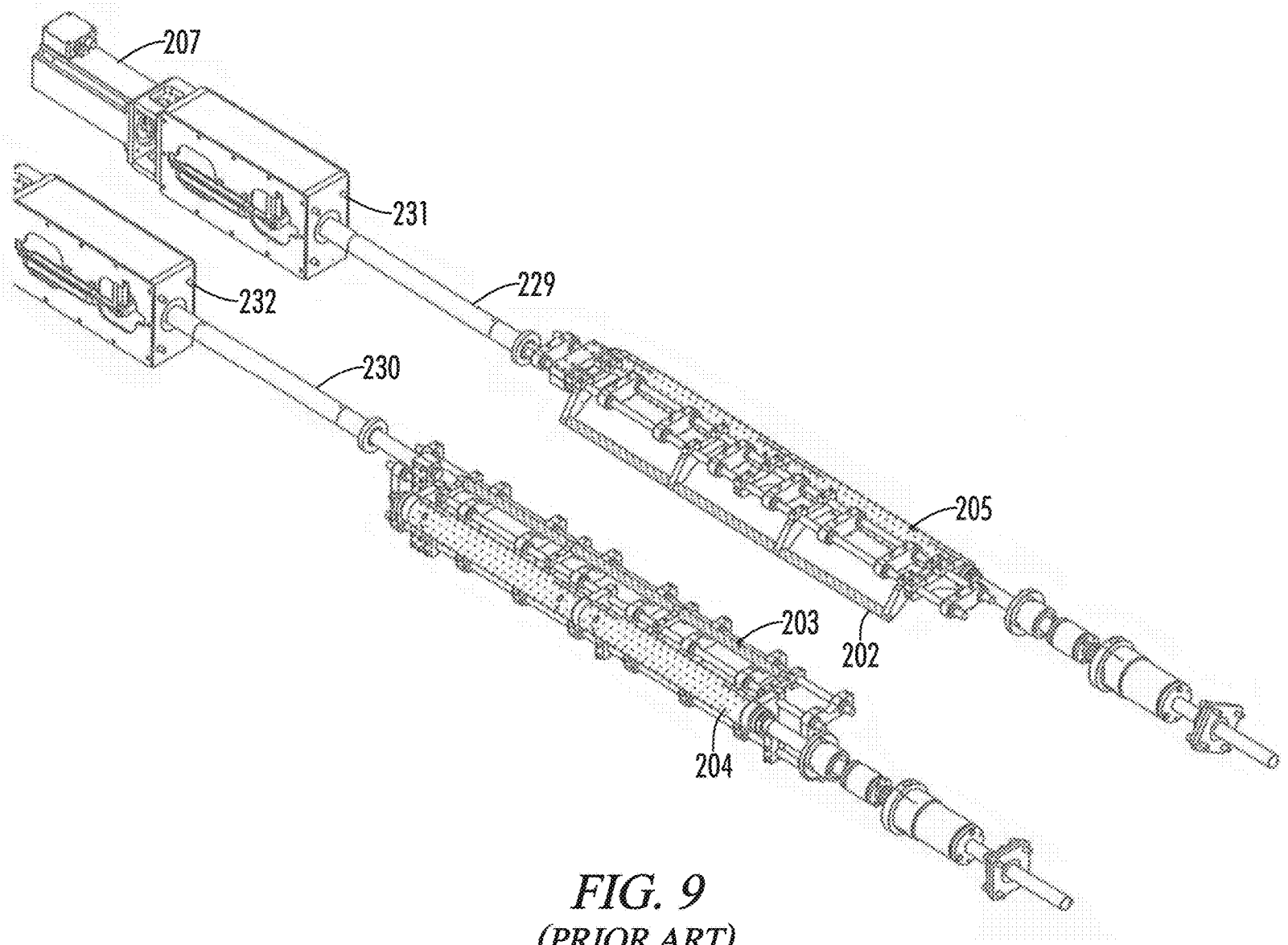
FIG. 9 (PRIOR ART)
FIG. 9 is a perspective view of the backing shifting apparatus in isolation.

FIGS. 8A and 8B show the tension roll assembly of FIG. 7 mounted on frame 100, and the three principal lateral frame beams 100A, 100B, 100C. FIG. 9 shows the shifting mechanism of that moves the entire cloth feed/backing feed assembly, including tension rolls, laterally with respect to the tufting machine. Liner drive motors 207 connect to drive blocks 231, 232 and thence to drive rods 229, 230 to communicate lateral movement to the tension roll assembly.

Figure 10A:
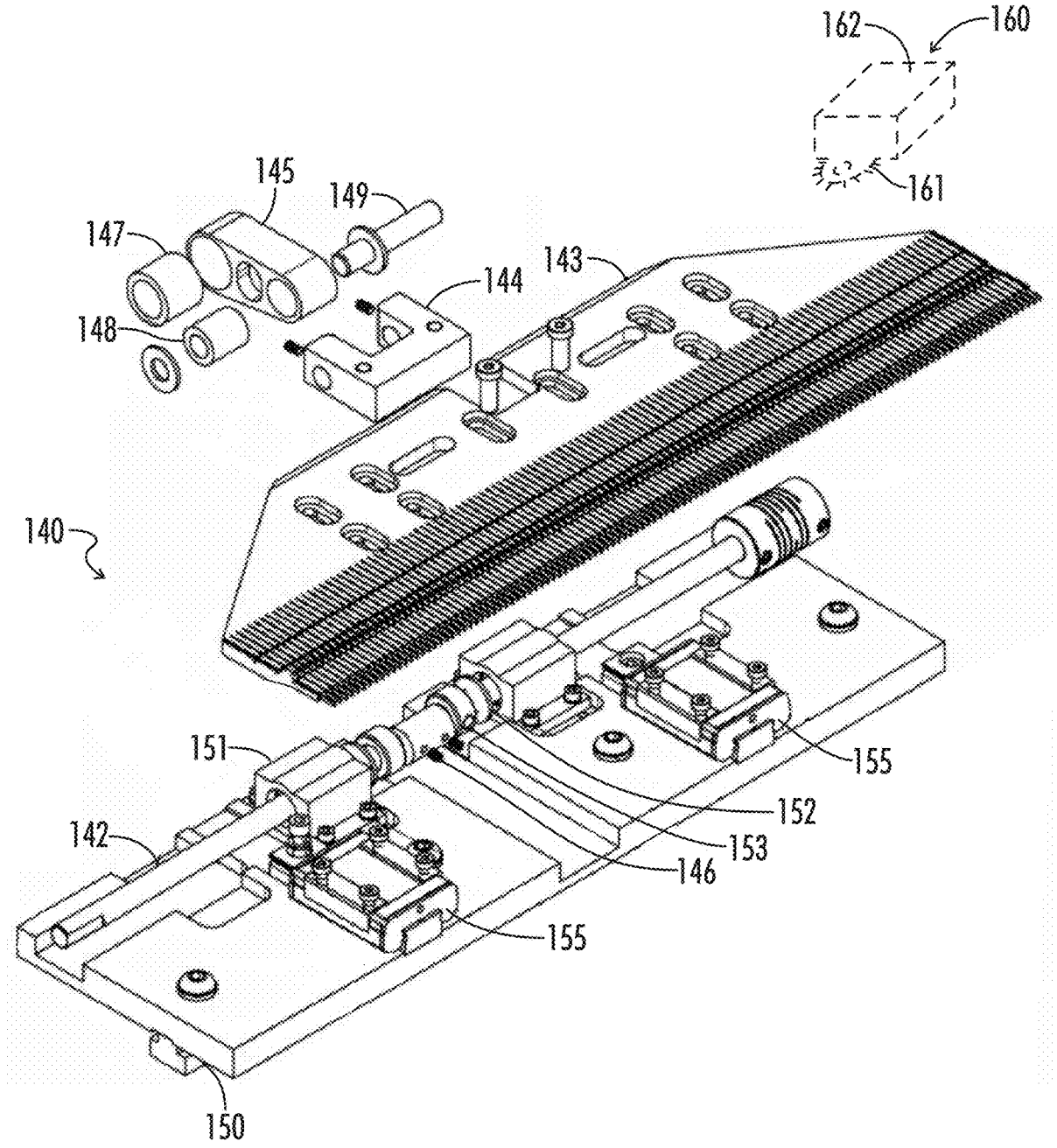
FIG. 10A is an exploded view of a section of an exemplary needle plate assembly.
Figure 11:
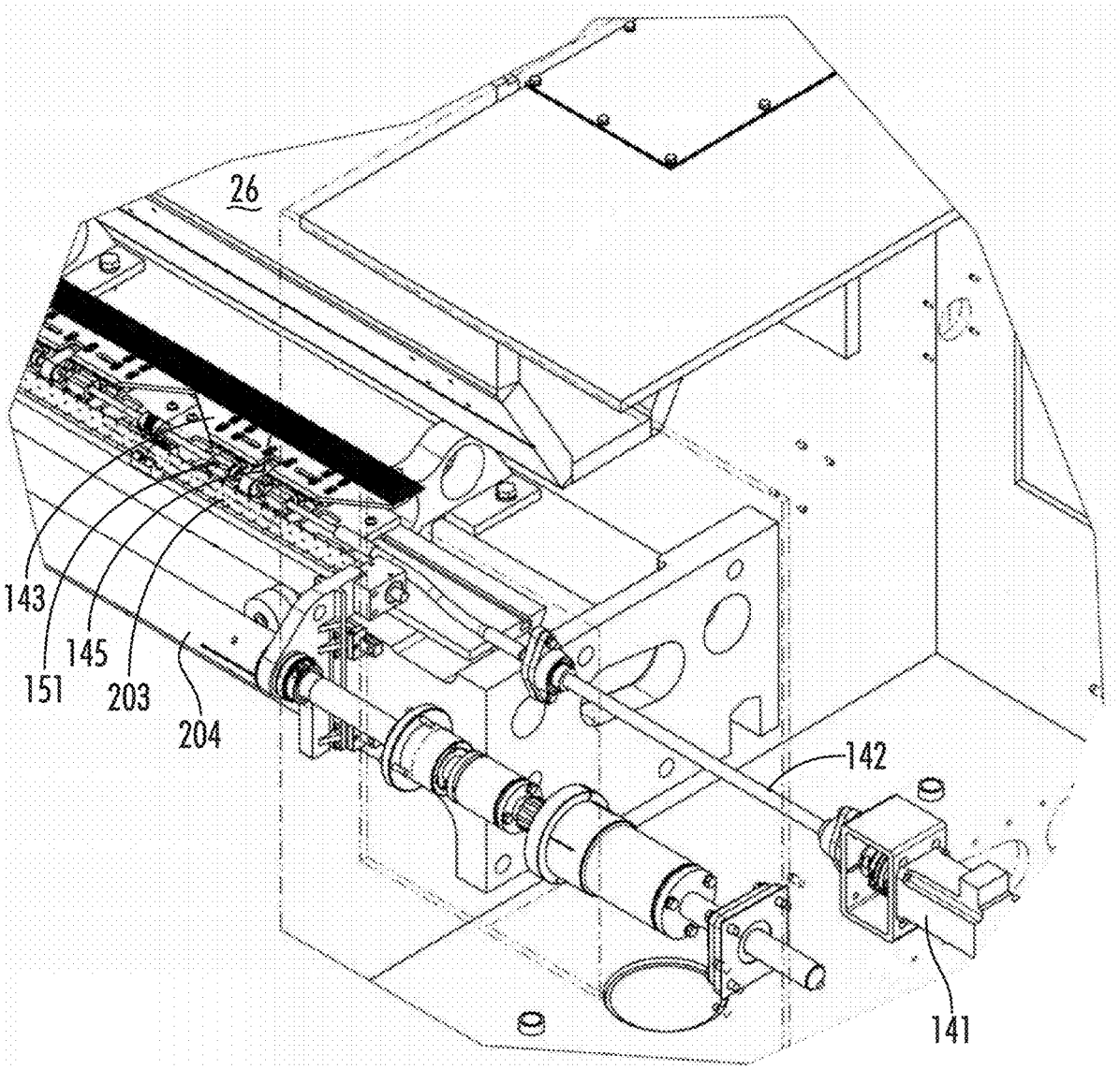
FIG. 11 is a partial sectional perspective view of an end of a tufting machine showing a servo motor drive for a reciprocating needle plate apparatus and equipped with a backing shifter.

Turning then to FIG. 10A, an exploded view of a reciprocating needle plate assembly 140 is shown. A base plate 150 secured to the tufting machine carries pillow blocks 151 with bearings to permit the rotation of shaft 142. Also, linear rail ball guides 155 are mounted to the base and the reciprocating needle plate 143 is mounted on those guides to control the longitudinal movement of the plate. The shaft 142 carries a cam 146 between collars 153 and thrust bearings 152 and pillow blocks 151. The cam 146 is set in a sleeve bearing 147 in one end of a connecting rod 145. The other end of the connecting rod 145 has a sleeve bearing 148 and is joined by a dowel 149 to wrist block 144 that is in turn fastened to the needle plate 143.

One feature that has proved helpful in maintaining the backing fabric in an unwrinkled state as it enters the tufting zone is the addition of temple roller assemblies 160 near each edge of the backing fabric. These assemblies contain temple rolls 161 that either by angular orientation as at pivots 162, or backing fabric engaging spike configuration, tend to keep the backing fabric stretched to its full width. Other tentering apparatus may also be used to the same effect.

Figure 10B:
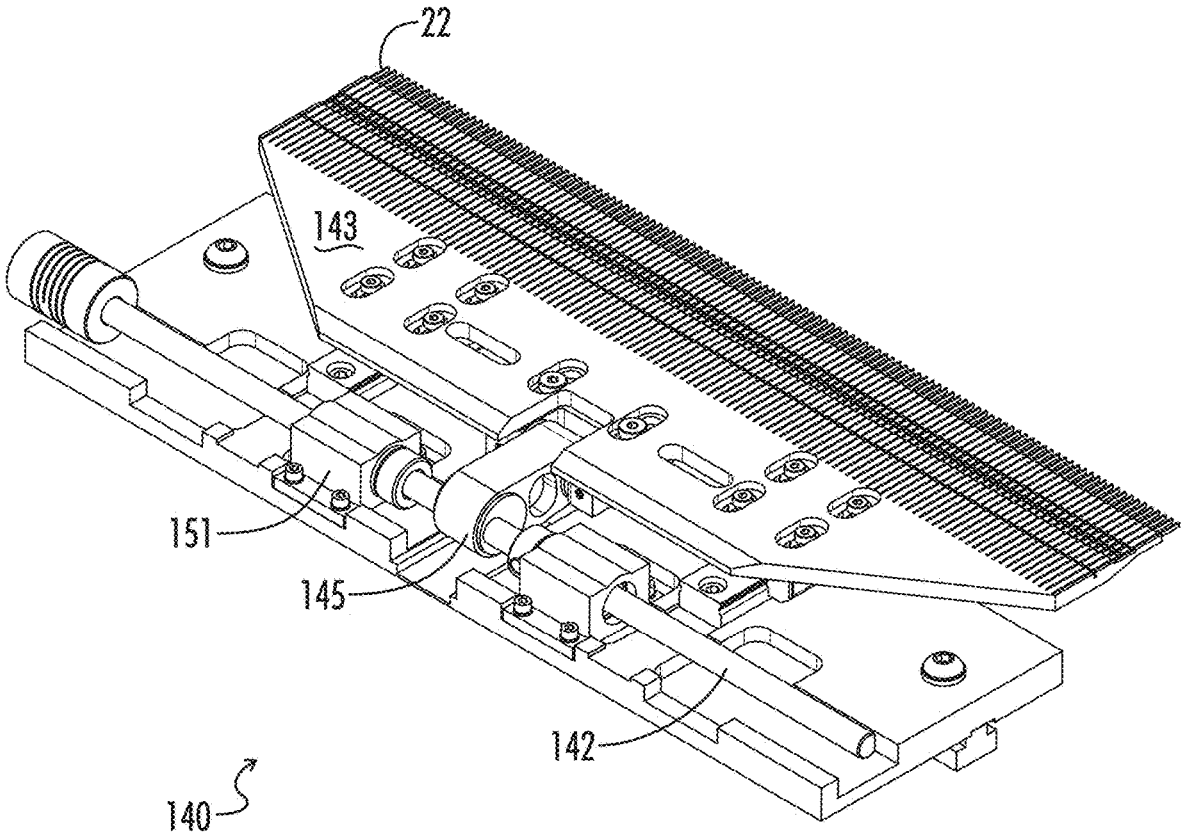
FIG. 10B is a perspective view of the reciprocating needle plate of FIG. 10A as put together for operation.

In FIG. 10B, it can be seen that the rotation of shaft 142 operated the cam to effect movement of the connecting rod 145 and the linear rail ball guides direct the needle plate 143 with rearwardly projecting needle plate fingers 22 to reciprocate in a forward and rearward direction. This movement corresponds to the movement shown in FIGS. 3-5. As shown in FIG. 11, shaft 142 is rotated by servo drive 141 and this means of control allows for alterations to the timing, or reciprocation window, relative to the position of the needles in an independent and rapid fashion. Other techniques for driving reciprocating needle plates are possible such as by linkage with other driven systems such as the main drive motors or looper drive, the use of pneumatics, hydraulics, or linear drive motors.

Figure 12A:
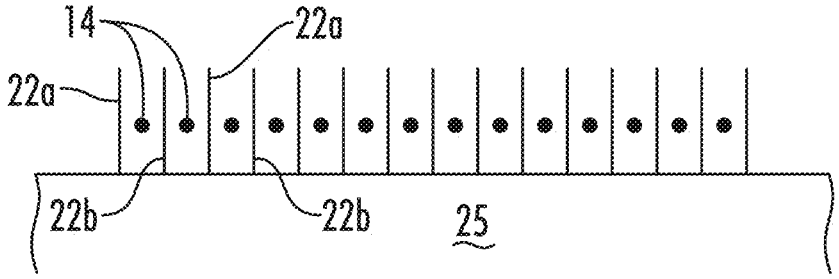
FIG. 12A is a top plan illustration of the needles and needle plate fingers of a reciprocating needle plate for a single row of needles.
Figure 12B:
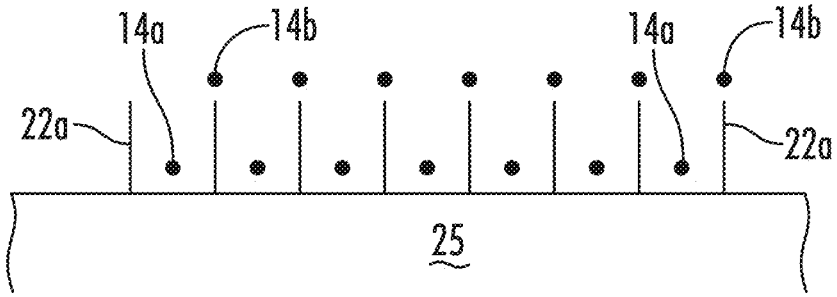
FIG. 12B is a top plan illustration of the location of the needles and needle plate fingers of a reciprocating needle plate for two rows of needles.

FIGS. 12A and 12B show the relative locations of needle plate fingers 22 and needles 14 in exemplary arrangements of one row of needles (FIG. 12A) and two rows of needles (FIG. 12B). When using a single row of needles 14 the needles are directly between needle plate fingers 22*a*, 22*b* at the time of penetrating the backing fabric. However, when two rows of needles are used, the front row of needles 14*a* are directly between needle plate fingers 22*a* at the time of penetrating the backing fabric. However, the rear row of needles 14*b* are located just beyond the ends of needle plate fingers 22*a*. Thus, the backing fabric near front needles 14*a* is supported by needle plate fingers 22*a* on either side, but the fabric near rear needles 14*b* is supported only by the end of the adjacent needle plate finger 22*a*. To improve the fabric support, in either case, it is sometimes helpful to place a riser beneath the face of the tufted greige to lift the tufted fabric upward as soon after the presser bar as practicable.

Advantageously, and different from prior usage in broadloom tufting machines, the backing assembly can be precisely shifted for substantial distances, typically on the order of 1 to 2.5 inches in each direction from center. This provides tufting machine with great versatility and allows a quarter gauge tufting machine to simulate an $1/8^{th}$ gauge tufting machine and provides numerous patterning advantages. Furthermore, an $1/8^{th}$ gauge tufting machine can very nearly imitate a $1/10^{th}$ gauge tufting machine, although not all stitches will appear in perfectly aligned rows. By way of example, a $1/8^{th}$ gauge machine will most commonly tuft at a stitch rate of about 8 stitches per inch, thereby placing 64 stitches in a square inch of backing. A $1/10^{th}$ gauge machine will most commonly tuft at about 10 stitches per inch with a resulting 100 stitches being placed in a square inch of backing. However, by increasing the stitch rate of a $1/8^{th}$ gauge tufting machine equipped with backing shifter and reciprocating needle plate to 12.5 stitches per inch, a stitch density of 100 stitches per square inch. In cases where the stitch rate is being increased by a multiple of the gauge of the backing shifter and reciprocating needle plate equipped machine, there may be a perfect pattern alignment. In other cases, the stitches may not align in exact longitudinal rows.

The failure to align in exact longitudinal rows may be perceived as an advantage in some tufting applications. For instance, solid color shifting is used when manufacturing solid color carpets to break up any streaks or irregularities in the yarns that might otherwise be noticeable. Residential solid color carpets are sometimes sewn on 5/32nds or $3/16^{th}$ inch gauge staggered needle bars with two rows of needles. These needle bars require shifts of 0.375 or 0.3125 inches for the streak break-up shifting. With a backing shifter and reciprocating needle plate equipped tufting machine, shifts of as little as 0.10 inches, and perhaps 0.05 inches, could be employed. The smaller shifts permit greater machine speed and require less lateral yarn on the backstitch that is effectively lost to effective use.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

What is claimed is:

1. A tufting machine for forming tufted fabrics, comprising:

at least one needle bar having a first series of needles mounted transversely across the width of the tufting machine;

a plurality of backing feed rolls for feeding a backing fabric through a tufting zone of the tufting machine;

a yarn feed mechanism for feeding a series of yarns to said needles;

at least one backing shifter for shifting the plurality of backing feed rolls transversely across the tufting zone;

a reciprocating needle plate beneath the backing fabric equipped for reciprocal longitudinal movement;

a series of gauge parts mounted below the tufting zone in a position to engage the first series of needles of the at least one needle bar being reciprocated into the backing material to form tufts of yarns in the backing fabric;

a control system for controlling and synchronizing the at least one backing shifter, a needle drive, the plurality of backing feed rolls, and the reciprocating needle plate.

2. The tufting machine of claim 1, further comprising temple rolls above the backing fabric.

3. The tufting machine of claim 1, wherein the reciprocating needle plate has rearwardly extending needle plate fingers and the first series of needles pass between the needle plate fingers when reciprocated into the backing fabric.

4. The tufting machine of claim 1, wherein the first series of needles comprises a first front row of transversely spaced needles and a second rear row of transversely spaced needles.

5. The tufting machine of claim 4, wherein the needle plate has rewardly extending needle plate fingers and the first front row of needles pass between the needle plate fingers when reciprocated into the backing fabric.

6. The tufting machine of claim 5, wherein the second rear row of needles pass immediately rearward of rear ends of the needle plate fingers when reciprocated into the backing fabric.

7. The tufting machine of claim 1, wherein the gauge parts are loopers.

8. The tufting machine of claim 1, wherein the series of needles is spaced transversely in a row having a gauge of 5/16ths, $1/5^{th}$, $1/6^{th}$, $1/8^{th}$, 1/10, 6/16ths, 10/32nds or $1/12^{th}$ inches.

9. The tufting machine of claim 1, wherein the at least one backing shifter is operable to shift the backing feed rolls transversely at least on inch from center position.

10. The tufting machine of claim 1, comprising a second needle bar having a second series of needles mounted transversely across the width of the tufting machine positioned rear of the at least one first needle bar.

11. The tufting machine of claim 10, wherein the reciprocating needle plate has rearwardly extending needle plate fingers that pass between the first series of needles on the first needle bar when reciprocated into the backing fabric.

12. The tufting machine of claim 11, second series of needles mounted on the second needle bar pass immediately rearward of rear ends of the needle plate fingers when reciprocated into the backing fabric.

* * * * *